US006550628B1

(12) United States Patent
Sedlmayr

(10) Patent No.: US 6,550,628 B1
(45) **Date of Patent: *Apr. 22, 2003**

(54) GRID OF A CAGE OF A PALLET CONTAINER

(75) Inventor: Rudolf Sedlmayr, Kleinblittersdorf (DE)

(73) Assignee: Roth Werke GmbH, Dautphetal (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/595,305

(22) Filed: Jun. 16, 2000

Related U.S. Application Data

(62) Division of application No. 09/254,971, filed on Mar. 16, 1999.

(30) Foreign Application Priority Data

Sep. 19, 1996 (DE) ..... 196 38 199
Jun. 6, 1997 (DE) ..... 197 23 806

(51) Int. Cl.[7] ..... B65D 19/00

(52) U.S. Cl. ..... 220/9.1; 220/9.4; 220/485; 220/23.91

(58) Field of Search ..... 220/9.1, 23.91, 220/9.4, 485; 206/386, 600, 595, 599

(56) References Cited

U.S. PATENT DOCUMENTS 2,422,239 A * 6/1947 Holt ..... 220/9.1
2,941,710 A * 6/1960 Smith et al. ..... 220/9.1
3,026,539 A * 3/1962 Lewis ..... 220/9.1
6,076,693 A * 6/2000 Reiter et al. ..... 220/9.4

* cited by examiner

*Primary Examiner*—Joseph M. Moy
(74) *Attorney, Agent, or Firm*—Friedrich Kueffner

(57) ABSTRACT

A grid has crossing grid bars, wherein the first grid bars extending in a first direction are made of an open profile having outwardly bent-away borders positioned in a common plane and wherein the second grid bars extending in a second direction are made of the same open profile as the first grid bars or of a closed profile having at least one planar profile wall. The first grid bars and the second grid bars are positioned relative to one another such that the bent-away borders rest against one another or that the bent-away borders of the first grid bars rest against the planar profile wall of the second grid bars and are connected to one another on the contact surfaces. The grid forms a wall of a cage for receiving a plastic container of a palette container for storing and transporting substances.

33 Claims, 2 Drawing Sheets

GRID OF A CAGE OF A PALLET CONTAINER

This application is a divisional of U.S. application Ser. No. 09/254,971, filed on Mar. 16, 1999, which was the National Stage of International Application No. PCT/EP97/05023, filed on Sep. 13, 1997.

BACKGROUND OF THE INVENTION

1. Field of the Invention

The invention relates to a grid of crossing grid bars, in particular, as a wall of a cage for receiving a plastic container in the context of a complete arrangement of a pallet container for storing and/or transporting substances.

2. Description of the Related Art

In conventional grids of this type the grid bars are round iron rods welded together at their crossing points. Grid casings for pallet containers are also known which are comprised of tubular grid bars that are indented at the crossing points and connected by resistance welding.

The grids made of round iron rods are heavy because they require a tight grid pattern to fulfill the static requirements of the substances to be stored/transported.

The grids of tubular rods are more lightweight. However, their manufacture of tubular rods is cumbersome insofar as the indentations must be produced in a separate working step at preset locations and the grid rods then can be used only in the thus predetermined manner.

SUMMARY OF THE INVENTION

It is an object of the present invention to provide a grid which is as light as possible for preset static requirements set by the substances to be stored/transported and which does not require preparations of the crossing locations at the grid bars.

In accordance with the present invention, this is achieved in that the first grid bars extending in one direction are comprised of an open profile having two outwardly bent-away borders extending in a common plane, in that the second grid bars extending in the other direction are also comprised of such profiles or of a closed profile that has at least one planar profile wall, and in that the first and second grid bars are positioned relative to one another such that the bent-away borders rest against one another or that the bent-away borders of the first grid bars rest against the aforementioned planar profile wall of the second grid bars and are connected to one another at the contact surfaces.

This grid is even lighter than the known grids of tubular grid bars for the same strength, because the tubular rods overall require a greater material cross-section as a result of the weakening at the indentation locations. The welding of the absolutely planar surfaces at the crossing points of the inventive grid is more controlled than at the indentations; instead of spot welding it is also possible to employ projection welding and, in principle, also resistance welding. Moreover, the open profile can be shaped of steel strip which can be easily galvanized completely, in contrast to the tubes which always have an interior that is not galvanized.

In comparison to the grids of round iron rods, in addition to the weight savings, there is also the advantage of a substantially reduced number of crossing points which must be welded.

Instead of welding, or in addition thereto, it is in principal also possible to provide at the bent-away borders a connection by stamping and/or punching.

In applications in which a greater torsional stiffness or buckling resistance is required, an open profile should be used for the grid bars extending in the one direction and a closed profile should be used for the grid bars extending in the other direction.

The open profile is provided with the bent-away borders, for example, at a profiled portion of a substantially square cross-section.

For use in a pallet container it could be preferred to have an embodiment in which the open profile has the bent-away borders provided at a profiled portion which adjacent to the bent-away borders has a rectangular cross-sectional part and adjacent thereto a trapezoidal cross-sectional part. The pallet containers can slide away from one another at the trapezoidal cross-sections when the careless positioning next to one another causes entanglement of the grid casings.

If it is desired to increase the strength or to reduce the possibilities of accidents, the bent-away borders can be folded over at the border edges.

The profile is thus stiffened and the border edges are rounded, a larger radius being produced at the same time.

In a further embodiment, the grid is provided at its borders with a surrounding profile.

This provides, on the one hand, increased strength as well as, on the other hand, increased safety. This measure is especially expedient at the top and bottom borders of a grid with vertical grid bars of an open profile: An open bent-away sheet metal profile is no longer buckle-resistant at ends not secured by a surrounding profile, and, moreover, the corners present a risk for injury.

Two variants of the surrounding profile are disclosed here in more detail:

In one embodiment a substantially U-shaped, preferably elongate rectangular, profile is provided and the surrounded ends of the grid bars are connected by welding and/or by stamping and/or by punching at least with their bent-away borders to one leg of the U-shaped profile, preferably also at the opposite side to the other leg of the U-shaped profile.

In the other embodiment it is suggested that the ends of the grid bars are pressed flat, that the surrounding profile rests with two parallel edges against the grid bar ends and is welded and/or connected by stamping and/or connected by punching to at least one flat side, preferably both flat sides, of the flat-pressed grid bars.

In the vertical positioning of the grid, which will be used in most applications, the U-shaped profile should generally be the most expedient for the bottom border. The vertical grid bars remain thus more stable in comparison to flat-pressed ends and the U-shaped profile provides various support and connecting possibilities. It can then be placed with its usually planar underside onto feet or other supports. The top edges of the sidewalls of the U-shaped profile, which are generally also planar, can serve as a support and connection to other components. With the especially suggested use of the grid in a pallet container they serve as a support and connection to the bottom.

The other surrounding profile for flat-pressed grid bar ends appears to be expedient in most cases for the top border of the grid. It can be round, or at least rounded, and is thus suitable for manual gripping and manipulation, which is occasionally necessary at the top border of, for example, a grid cage. In the especially suggested use of the grid in a pallet container, the profile and its connection to flat-pressed grid bar ends, on the other hand, provides enough strength to place a further pallet container on top.

DESCRIPTION OF THE PREFERRED EMBODIMENTS

Figure 2:
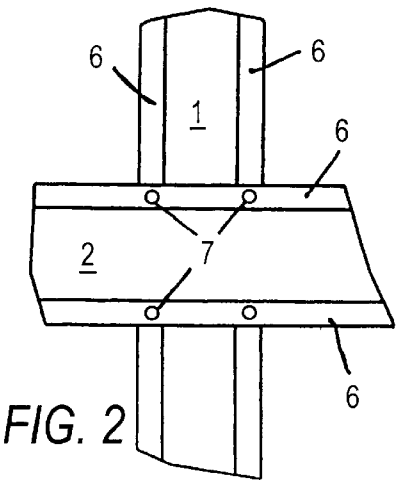
FIG. 2 shows a detail designated by II in FIG. 1, on an enlarged scale.
Figure 7:
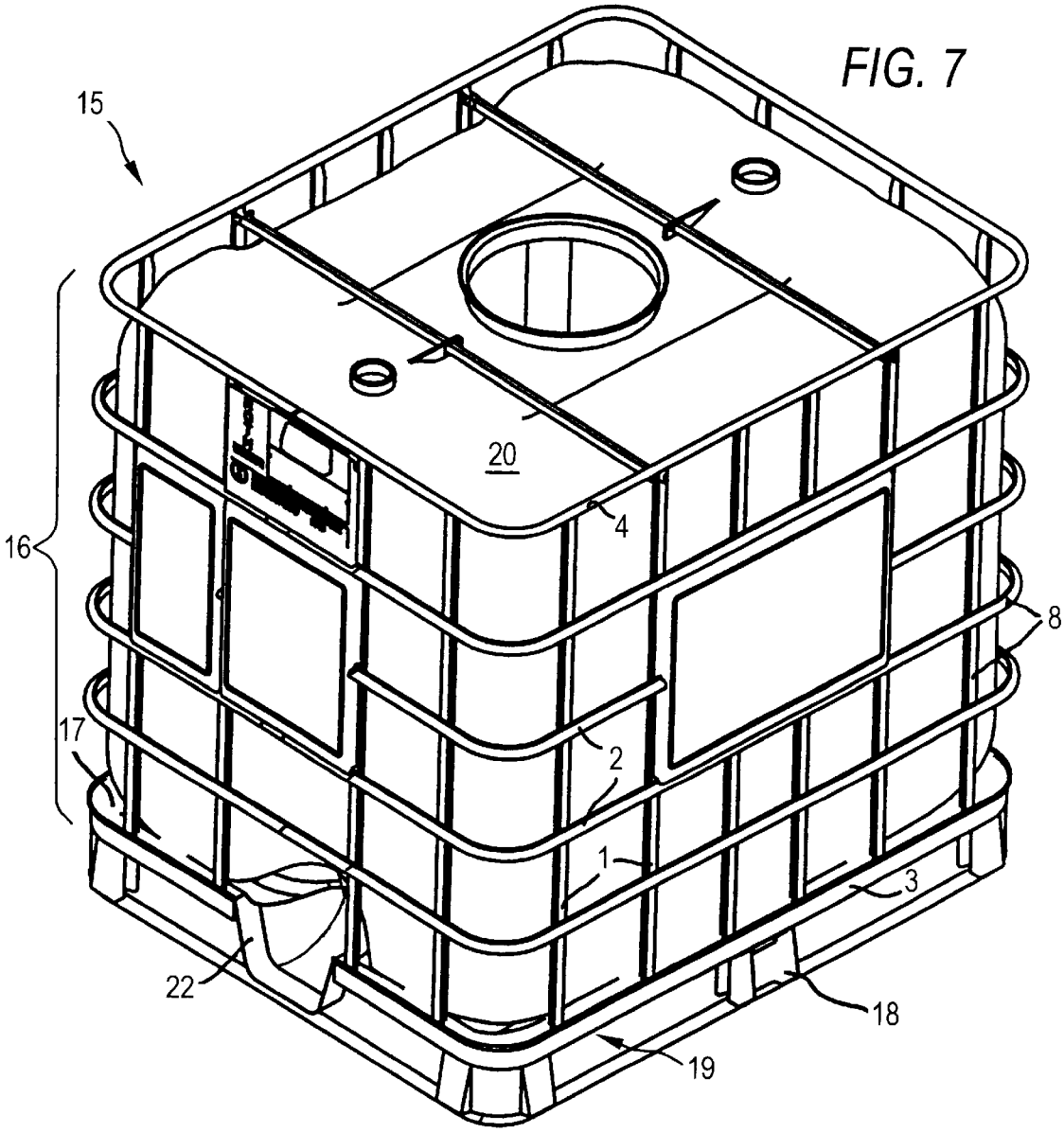
FIG. 7 shows an isometric illustration of a pallet container produced by using the grid of FIG. 1.

The grid is made of vertical grid bars 1, horizontal grid bars 2, an U-shaped profile 3, which surrounds the bottom ends of the vertical grid bars 1, as well as a profile 4 which surrounds the top ends of the vertical grid bars 1. The grid bars 1 and 2 are comprised of a hat profile having two outwardly bent-away borders 6 connected to profile section 5 of a square cross-section. The grid bars 1, 2 butt against one another by means of the bent-away borders 6 at the points of intersection (crossing points) and are spot welded, projection welded or resistance welded on the contact surface, as is indicated in FIG. 2 at 7.

Figure 6:
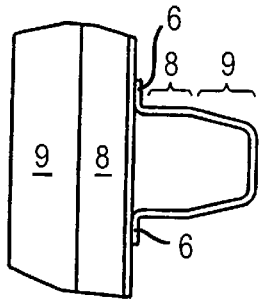
FIG. 6 shows a modification of FIG. 3.

FIG. 6 shows a modification where the profile section 5 is replaced by a profile section made up of a rectangular cross-sectional part 7 and a trapezoidal cross-sectional part 8.

Figure 4:
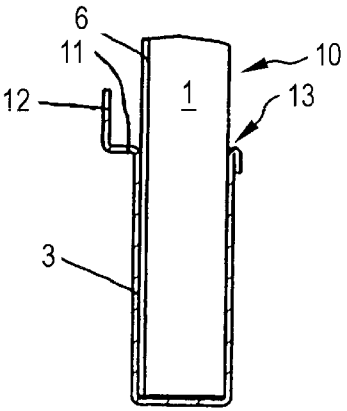
FIG. 4 shows the detail IV of FIG. 1 on an enlarged scale as viewed from the right of FIG. 1.
Figure 3:
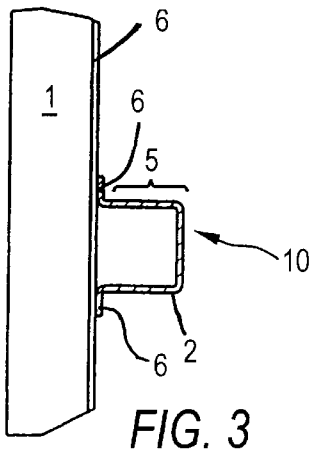
FIG. 3 shows the detail of FIGS. 1 and 2 as viewed from the left.

The cross-section of the profile 3 is illustrated in FIG. 4. In the U-shaped profile 3, the hat profile of the grid bars 1, which reach as far as the base of the profile 3, butts against the two legs, to be precise, the bent-away borders 6 butt against the one leg of the profile 3 and the end surface 10 of the profile section 5 butt against the other leg of the profile 3. Welding is possible on all three contact surfaces. It is carried out at least on the two bent-away borders 6.

One profile leg of the profile 3 is bent outwardly, producing a horizontal bearing surface 11 and a vertical flange border 12. Level with the horizontal bearing surface 11, the inner profile leg is folded over and thus forms a stiffened rest 13. Further details will be given of these functions.

At the top border of the grid, the hat profile of the grid bars 1 is pressed flat at 14. The profile 4 which is placed in position here grips the flat-pressed end on both flat sides and is welded thereto on both flat sides.

The pallet container 1 produced by using the disclosed grid comprises a cage 16, of which the base, which is configured as a shallow tray 17, is supplemented by a base framework 18 to form a pallet 19, and also comprises a plastic container 20 which is received by the cage 16. The plastic container 20 is produced, via blow-molding, in cuboidal form with rounded edges and corners. To match the base of the plastic container 20, the tray 17 has an arched border region. Over the height of the plastic container 20, the grid casing 21 of the cage 16 is adapted to the periphery of the container.

Figure 1:
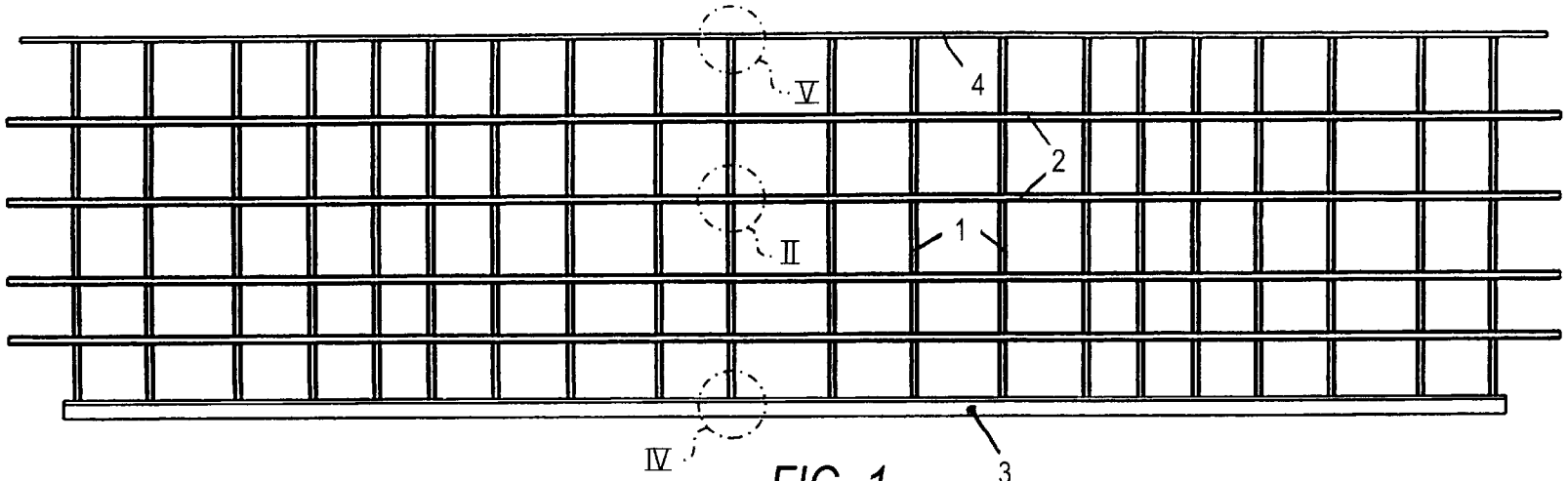
FIG. 1 shows a view of a grid.
Figure 5:
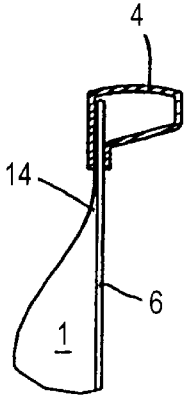
FIG. 5 shows a detail V in FIG. 1, on an enlarged scale as viewed from the left in FIG. 1.

The grid casing 21 has been produced from the grid shown in FIG. 1 by being bent at the four side edges of the cage 16 and closed at the center of one narrow side surface, wherein the ends of the horizontal grid bars 2 have been placed into one another in an overlapping fashion.

The base 17 is placed onto the stiffened rest 13 and the horizontal bearing surface 11 of the profile 3 wherein the grid bars 1 are received in matching cutouts of the border of the base (shallow tray) 17. The vertical flange border 12 is flanged to (bent over) the edge of the shallow tray 17. The shallow tray 17 is thus connected to the grid casing 21. The resulting cage 16 is screwed to the base framework 18.

The plastic container 20 has a discharge opening (not shown) indicated at 22.

All the constituent parts of the cage 16 and of the base framework 18 preferably consist of galvanized sheet steel.

While specific embodiments of the invention have been shown and described in detail to illustrate the inventive principles, it will be understood that the invention may be embodied otherwise without departing from such principles.

What is claimed is:

1. A grid comprised of crossing grid bars, wherein the first grid bars extending in a first direction are comprised of a longitudinally open profile having outwardly bent-away longitudinal borders positioned in a common plane and wherein the second grid bars extending in a second direction are comprised of the same open profile as the first grid bars, wherein the first grid bars and the second grid bars are positioned relative to one another such that the bent-away longitudinal borders rest against one another with contact surfaces, and wherein the first and second grid bars are connected to one another on the contact surfaces.

2. The grid according to claim 1, forming a wall of a cage for receiving a plastic container of a palette container for storing and/or transporting substances.

3. The grid according to claim 1, wherein the first and second grid bars are connected to one another by welding.

4. The grid according to claim 3, wherein the first and second grid bars are connected by spot welding.

5. The grid according to claim 1, wherein the first grid bars and the second grid bars having bent-away borders are connected to one another by at least one of stamping and punching.

6. The grid according to claim 1, wherein the open profile has a profile section of a substantially square cross-section and wherein the bent-away borders are connected to opposite sides of the square cross-section.

7. The grid according to claim 1, wherein the open profile has a profile section comprised of a rectangular cross-section and adjacent thereto a trapezoidal cross-section, wherein the bent-away borders are connected to the rectangular cross-section.

8. The grid according to claim 1, wherein the bent-away borders are folded back at the edge border.

9. The grid according to claim 1, comprising surrounding profiles positioned at the borders.

10. The grid according to claim 9, wherein the surrounding profile is a substantially U-shaped profile and the ends of the grid bars enclosed by the surrounding profile are connected by at least one of welding and stamping and punching with the bent-away borders to a first leg of the U-shaped profile.

11. The grid according to claim 10, wherein the ends of the grid bars are connected to the second leg of the surrounding profile.

12. The grid according to claim 10, wherein the U-shaped profile has an elongate rectangular cross-section.

13. The grid according to claim 9, wherein the ends of the grid bars are pressed flat, wherein the surrounding profile has two parallel edges resting against the ends of the grid bars and is connected by at least one of welding and stamping and punching to one flat side of the ends of the grid bars.

14. The grid according to claim 13, wherein the surrounding profile is connected to both flat sides of the ends of the grid bars.

15. The grid according to claim 1, wherein the profiles of the grid bars are comprised of angled steel sheet.

16. The grid according to claim 1, wherein the profiles of the grid bars are comprised of galvanized steel sheet.

17. A grid comprised of crossing grid bars, wherein the first grid bars extending in a first direction are comprised of a longitudinally open profile having outwardly bent-away longitudinal borders positioned in a common plane and wherein the second grid bars extending in a second direction are comprised of a longitudinally closed profile having at least one planar profile wall, wherein the first grid bars and the second grid bars are positioned relative to one another such that the bent-away borders of the first grid bars rest against the planar profile wall of the second grid bars with contact surfaces, and wherein the first and second grid bars are connected to one another on the contact surfaces.

18. The grid according to claim 3, wherein the first and second grid bars are connected by projection welding.

19. The grid according to claim 17, forming a wall of a cage for receiving a plastic container of a palette container for storing and/or transporting substances.

20. The grid according to claim 17, wherein the first and second grid bars are connected to one another by welding.

21. The grid according to claim 20, wherein the first and second grid bars are connected by spot welding.

22. The grid according to claim 20, wherein the first and second grid bars are connected by projection welding.

23. The grid according to claim 17, wherein the open profile has a profile section of a substantially square cross-section and wherein the bent-away borders are connected to opposite sides of the square cross-section.

24. The grid according to claim 17, wherein the open profile has a profile section comprised of a rectangular cross-section and adjacent thereto a trapezoidal cross-section, wherein the bent-away borders are connected to the rectangular cross-section.

25. The grid according to claim 17, wherein the bent-away borders are folded back at the edge border.

26. The grid according to claim 17, comprising surrounding profiles positioned at the borders.

27. The grid according to claim 26, wherein the surrounding profile is a substantially U-shaped profile and the ends of the grid bars enclosed by the surrounding profile are connected by at least one of welding and stamping and punching with the bent-away borders to a first leg of the U-shaped profile.

28. The grid according to claim 27, wherein the ends of the grid bars are connected to the second leg of the surrounding profile.

29. The grid according to claim 27, wherein the U-shaped profile has an elongate rectangular cross-section.

30. The grid according to claim 26, wherein the ends of the grid bars are pressed flat, wherein the surrounding profile has two parallel edges resting against the ends of the grid bars and is connected by at least one of welding and stamping and punching to one flat side of the ends of the grid bars.

31. The grid according to claim 30, wherein the surrounding profile is connected to both flat sides of the ends of the grid bars.

32. The grid according to claim 17, wherein the profiles of the grid bars are comprised of angled steel sheet.

33. The grid according to claim 17, wherein the profiles of the grid bars are comprised of galvanized steel sheet.

* * * * *